United States Patent [19]

Gustafsson et al.

[11] 4,170,807

[45] Oct. 16, 1979

[54] FASTENER MEANS

[76] Inventors: Lars Gustafsson, Leires vag 36, Lerum, Sweden, 443 00; Ulf G. Källqvist, Traststigen 4B, Mölnlycke, Sweden, 435 00

[21] Appl. No.: 832,735

[22] Filed: Sep. 12, 1977

[30] Foreign Application Priority Data

Sep. 20, 1976 [SE] Sweden ..... 7610383

[51] Int. Cl.[2] ..... A44B 21/00

[52] U.S. Cl. ..... 24/137 R; 24/255 R

[58] Field of Search ..... 24/137 R, 139, 255 R, 24/67.9

[56] References Cited

U.S. PATENT DOCUMENTS

| | | | |
|---|---|---|---|
| 450,266 | 4/1891 | Truax | 24/255 R |
| 826,965 | 7/1906 | Ruhlow | 24/139 |
| 2,014,971 | 9/1935 | Knutson | 24/213 R |
| 2,938,252 | 5/1960 | Scheemaeker | 24/259 R |
| 3,923,213 | 12/1975 | George | 24/255 R |

FOREIGN PATENT DOCUMENTS

| | | | |
|---|---|---|---|
| 713013 | 10/1941 | Fed. Rep. of Germany | 24/67.9 |
| 26508 | 3/1954 | Finland | 24/137 R |
| 322504 | 11/1934 | Italy | 24/139 |
| 619662 | 3/1949 | United Kingdom | 24/67.9 |

*Primary Examiner*—Bernard A. Gelak

*Attorney, Agent, or Firm*—Harness, Dickey & Pierce

[57] ABSTRACT

A fastener device particularly intended to secure articles, such as washing, on a washing line. The fastener device comprises a flat gripping section and two arms sections which extend arcuately downwards from the gripping section, in a direction towards one another and such that the arm end portions cross over, whereby between the gripping section and the arms an aperture is formed to accommodate the line and the washing. To secure the washing on the line, the fastener device is fitted over the line and the washing with the gripping section and arms at right angles to the line, whereafter the fastener device is turned over a quarter of a turn, whereby a torsional force is generated in the arms, effecting the securement of the washing.

7 Claims, 5 Drawing Figures

FASTENER MEANS

BACKGROUND OF THE INVENTION

The present invention concerns a device designed to secure and fasten washing on a line, and comprising an upper section serving as a gripping portion, and two arms projecting from the upper portion. The clothes-peg most commonly used today consists of three parts, viz. two leg sections and a spring interconnecting the legs. Two recurrent deficiencies of this kind of clothes-peg are on the one hand that the legs often break at the point where pressure is exerted by the thumb and on the other that the legs often disengage from the spring, whereby the peg falls apart into its components. Further disadvantages are inconvenient handling and complicated assembly, requiring special tools.

The purpose of the subject invention is to provide means whereby washing may be easily and conveniently secured and fastened on a line and be removed therefrom while also allowing safer functioning and lower manufacturing costs. A further object of the invention is to provide a clothes-peg so designed as to allow the entire peg to be given an almost flat disc shape whereby the peg may be stacked easily and in a compact space-saving manner. Owing to the flat shape the peg may conveniently be used as the carrier of advertising texts and the like and be distributed e.g. in washing powder packages without occupying any significant space therein.

SUMMARY OF THE INVENTION

These and other advantages and possibilities which will become apparent upon reading of the following detailed description are obtained in that use is made of the torsional force of at least two gripping arms incorporated in the device in accordance with the invention. When washing is to be secured on a line, the gripping arms of the fastener device are forced down over the line on either side thereof, whereafter the gripping arms are turned and a torsional force is generated. Release is effected by simply turning and lifting the device.

To achieve the advantages outlined above, the device in accordance with invention is characterised in that the arms extend arcuately towards one another and cross one another such that between the upper section which is essentially flat to serve as an exposure face carrying advertisements and the like printed thereon, and that between the top section and the crossed arms is formed an aperture of a shape to accomodate the line when the device is fitted over the latter and the washing and then is turned over a quarter of one turn, whereby a torsional force retaining and fastening the washing is generated in the arms.

In accordance with a preferred embodiment, the crossed arms extend from the upper section in two adjacent planes and overlap, whereby an initial tension is generated in the arms, in addition to which a guiding aperture is provided to facilitate application of the device over the line and the washing.

Furthermore, the device in accordance with the invention may be formed from two parts which are joined together, and each such part comprises one of the gripping arms that take the torsional force. Preferably, the device is manufactured from a transparent material.

BRIEF DESCRIPTION OF THE DRAWINGS

The invention will be described in detail in the following with reference to the accompanying drawings, wherein.

DETAILED DESCRIPTION OF A PREFERRED EMBODIMENT

Figure 1:
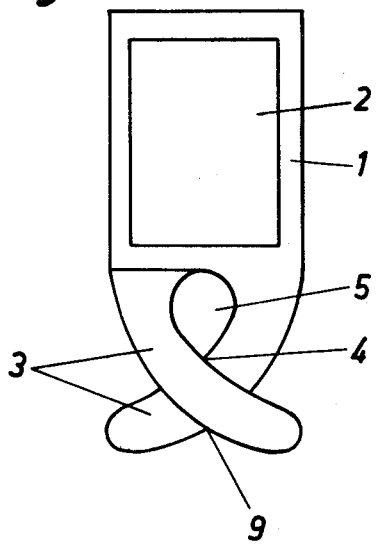
FIG. 1 illustrates the device in a front view.
Figure 2:
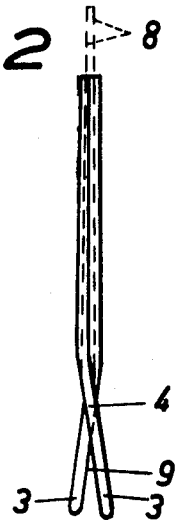
FIG. 2 illustrates the device in a side view.

In accordance with the embodiment illustrated in the drawings, the upper part of the device is shaped as a flat surface 1 serving as a gripping portion and preferably designed as an exposure face 2. From the upper portion of the device project two arms 3 which are arranged to take torsional stress and which extend arcuately and cross over a cross-over point 4 whereby an aperture 5 is formed intermediate the upper portion 1 and the crossed arms 3 to accommodate a washing-line when the device is fitted over said lin 6 and washing 7. The arms 3 depart from the upper portion 1 in two adjacent planes 8 and intersect in cross-over point 4 in that the arms 3 are positioned in overlapping relationship, which generates an initial tension in the arms 3 which ensures safe securement of the washing 7 irrespective of the thickness thereof. On account of the arrangement of the arms 3 in overlapping fashion, a guiding aperture 9 is furthermore formed, which facilitates application of the peg.

The device preferably consists of two interconnected sections 10, 11 each one of which incorporates one of the gripping arms 3 that take the torsional stress. In that the sections are interconnected in overlapping fashion, the requirements outlined above are met.

In accordance with one embodiment of the invention the peg is manufactured from a transparent material allowing printed advertisement material or other information to be embedded into the material or be sandwiched between the two sections in case the peg is formed by two interconnected sections. The peg is preferably manufactured from moulded plastics material. It is likewise possible to provide the peg with advertising texts and the like during the moulding process proper.

Figure 3:
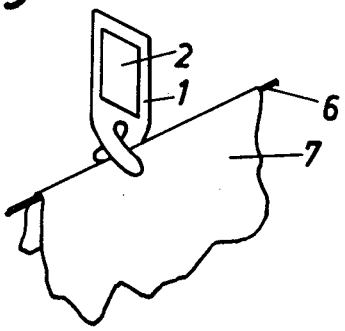
FIGS. 3 and 4 illustrate the device during use thereof.
Figure 4:
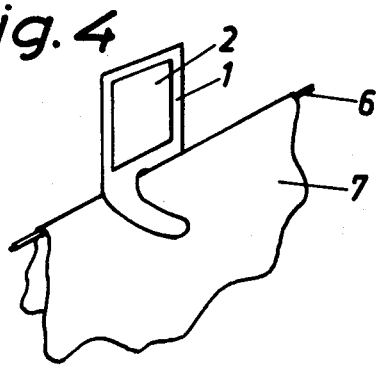
Figure 5:
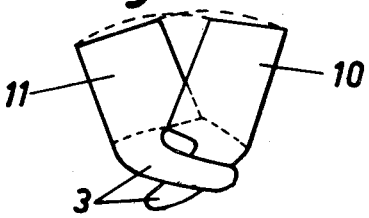
FIG. 5 illustrates the assembly of the two device parts.

When the peg is to be used as a fastener means it is pressed downwards at right angles to the line 6 (FIG. 3) and then turned over a quarter of one turn (FIG. 4). This generates a torsional force tending to close the gripping arms 3, whereby a parallel pressure is generated against the washing 7. The peg and the washing are thus fastened. Release is effected by simply turning and lifting the peg.

What we claim is:

1. A fastening device to fasten and secure wash on a line comprising an upper section serving as a gripping portion adapted to extend in substantially parallel relation with the line and extending upwardly therefrom a sufficient distance to be gripped for insertion and removal and two resilient arms depending from said upper section, said arms being of uniform thickness and width and extending from respective opposite sides of a medial plane passing through said gripping portion of said upper section from one side of said medial plane to the other, said arms intersecting each other in a first plane perpendicular to said medial plane, at a point spaced from said upper section to define an aperture having a shape to accommodate the wash and line when said fastening device is secured thereover, said arms also intersecting each other in a second plane perpendicular to said first plane and parallel to said medial plane to exert a torsional force for securing the wash to the line through said arms.

2. A fastening device as set forth in claim 1 wherein the arms extend in the first plane past their point of intesection and define a guiding aperture to facillitate application of said fastening device over the line and the wash.

3. A fastening device according to claim 1 wherein the gripping portion is substantially flat in the first plane and seves as an exposure face for display of printed material.

4. A fastener device according to claim 1 wherein said fastener device consists of two interconnected sections, and wherein each section is formed with a respective one of said gripping arms.

5. A fastener device according to claim 2 wherein said fastener device consists of two interconnected sections, and wherein each sections is formed with a respective one of said gripping arms.

6. A fastening device as set forth in claims 4 or 5 wherein each of the sections includes a substantially flat portion comprising the upper section of said fastening device for serving as an exposure face for display of printed material, said flat portions being parallel with said first plane.

7. A fastener device according to claim 1, wherein said fastener device is fabricated from a transparent material.

* * * * *